United States Patent [19]

Eylon et al.

[11] Patent Number: 4,872,927

[45] **Date of Patent: * Oct. 10, 1989**

[54] METHOD FOR IMPROVING THE MICROSTRUCTURE OF TITANIUM ALLOY WROUGHT PRODUCTS

[75] Inventors: Daniel Eylon, Dayton; Francis H. Froes, Xenia, both of Ohio; Charles F. Yolton, Coraopolis, Pa.

[73] Assignee: The United States of America as represented by the Secretary of the Air Force, Washington, D.C.

[ * ] Notice: The portion of the term of this patent subsequent to Feb. 28, 2006 has been disclaimed.

[21] Appl. No.: 128,841

[22] Filed: Dec. 4, 1987

[51] Int. Cl.[4] ..... C21D 1/00

[52] U.S. Cl. ..... 148/20.3; 148/133; 148/421

[58] Field of Search ..... 148/20.3, 133, 421

[56] References Cited

U.S. PATENT DOCUMENTS

| | | | |
|---|---|---|---|
| 2,892,742 | 6/1959 | Zwicker et al. | 148/11.5 F |
| 4,415,375 | 11/1983 | Lederich et al. | 148/11.5 F |
| 4,482,398 | 11/1984 | Eylon et al. | 148/133 |
| 4,505,764 | 3/1985 | Smickley et al. | 148/133 |
| 4,534,808 | 8/1985 | Eylon et al. | 148/133 |
| 4,536,234 | 8/1985 | Eylon et al. | 148/133 |
| 4,612,066 | 9/1986 | Levin et al. | 148/133 |
| 4,622,079 | 11/1986 | Chang et al. | 148/133 |
| 4,624,714 | 11/1986 | Smickley et al. | 148/133 |
| 4,631,092 | 12/1986 | Ruckle et al. | 148/133 |
| 4,655,855 | 4/1987 | Levin et al. | 148/20.3 |
| 4,680,063 | 7/1987 | Vogt et al. | 148/133 |
| 4,714,587 | 12/1987 | Eylon et al. | 148/133 |

OTHER PUBLICATIONS

W. R. Kerr et al, Hydrogen as an Alloying Element in Titanium (Hydrovac), *Titanium* '80 *Science and Technology* (1980), pp. 2477–2486.

*Primary Examiner*—L. Dewayne Rutledge
*Assistant Examiner*—David W. Schumaker
*Attorney, Agent, or Firm*—Charles E. Bricker; Donald J. Singer

[57] ABSTRACT

A method for improving the microstructure of wrought titanium alloy material which comprises the steps of hydrogenating the material at a temperature near or above the titanium-hydrogen eutectoid of 815° C. (about 780° to 1020° C.) to a hydrogen level of about 0.50 to 1.50 weight percent, cooling the thus-hydrogenated material to room temperature, heating the thus-cooled, hydrogenated material to a temperature of about 650° to 750° C., applying a vacuum to dehydrogenate the material and cooling the dehydrogenated material to room temperature at a controlled rate.

6 Claims, 1 Drawing Sheet

METHOD FOR IMPROVING THE MICROSTRUCTURE OF TITANIUM ALLOY WROUGHT PRODUCTS

RIGHTS OF THE GOVERNMENT

The invention described herein may be manufactured and used by or for the Government of the United States for all governmental purposes without the payment of any royalty.

BACKGROUND OF THE INVENTION

This invention relates to titanium alloy wrought products. In particular, it relates to a method for improving the microstructure of wrought titanium alloys.

Titanium and titanium alloys are extremely valuable in uses where light weight and high strength-to-weight ratio are important. In order to fully take advantage of the strength and weight properties of titanium, it is often desirable to utilize hot or cold forming techniques to form complex shapes. Complex parts are parts having a shape of such complexity that they cannot be readily formed by standard casting, molding, forging, machining and welding techniques.

Sheet metal forming is typically used to form sheet stock of about 0.020 to 0.25 inch thickness. In superplastic forming, a die having a desired shape is used. A piece of stock of titanium alloy, such as a sheet of the alloy, is introduced into the die.

The part is normally heated in the die. In the die, the pressure on one side of the stock is reduced and the pressure on the other side of the stock is increased to establish a pressure differential of at least about 100 psi. The difference in pressure forces the stock to flow into the die and assume the desired shape conforming to the die.

This method of forming allows the fabrication of complex shaped, formed parts which can take full advantage of the high strength-to-weight ratios inherent in titanium and its alloys. To adequately superplastically form titanium and its alloys into useful parts, it is necessary for the stock to have a fine grain size (below about 10 microns) and, preferably, a microstructure which contains alpha and beta phases.

Lederich et al, U.S. Pat. No. 4,415,375 (Nov. 15, 1983) disclose a method for superplastically forming titanium and titanium alloys which comprises treating a stock piece of titanium or titanium alloy with hydrogen to form a transient alloy containing hydrogen, superplastically forming the hydrogen containing piece, and thereafter, removing the hydrogen from the formed piece.

Zwicker et al, U.S. Pat. No. 2,892,742 (June 30, 1959) disclose a process for hot working of titanium alloys which comprises incorporating about 0.05 to 1 weight percent of hydrogen into such alloys, hot working the hydrogen-containing alloys, and removing the hydrogen therefrom after the hot working has been completed.

Although Zwicker et al and Lederich et al have disclosed that hydrogen is beneficial as a transient alloying element for improving the hot workability and superplasticity of titanium and its alloys, pure titanium and many titanium alloys are embrittled at room temperature by the presence therein of only very small quantities of hydrogen. This embrittlement causes a lowered impact resistance. In order to obtain good mechanical properties at room temperature, it is necessary to remove the hydrogen therefrom after hot working or superplastic forming has been completed.

Further, the improved hot workability of titanium alloys containing hydrogen does not extend to alloys which are temporarily alloyed with hydrogen, then dehydrogenated under vacuum prior to hot forging. W. R. Kerr et al, "Hydrogen as an Alloying Element in Titanium (Hydrovac)", *Titanium* '80 *Science and Technology*, (1980) pp 2477–2486.

While it is desirable to improve the superplastic workability behavior of titanium alloys, it is less than desirable to have hydrogen present at the superplastic forming site.

Accordingly, it is an object of this invention to provide a method for improving the microstructure of titanium alloy materials, particularly wrought titanium alloy sheetstock materials.

Other objects and advantages of the present invention will be apparent to these skilled in the art from a reading of the following detailed description of the invention.

SUMMARY OF THE INVENTION

In accordance with the present invention, there is provided a method for improving the microstructure of wrought titanium alloy sheetstock which comprises the steps of hydrogenating the sheetstock at a temperature of about 780° to 1020° C. to a hydrogen level of about 0.50 to 1.50 weight percent, cooling the thus-hydrogenated sheetstock to room temperature, heating the thus-cooled, hydrogenated sheetstock to a temperature of about 650° to 750° C., applying a vacuum to dehydrogenate the sheetstock and cooling the sheetstock to room temperature at a controlled rate.

DESCRIPTION OF THE DRAWING

In the drawing,

Referring now to the drawing, FIG. 1 illustrates a typical microstructure of mill annealed Ti-6Al-4V. FIG. 1 reveals a relatively large, similarly aligned, colony of long lenticular alpha plates separated by a small amount of continuous intergranular beta phase.

FIG. 2 illustrates the microstructure of a coupon which was hydrogenated above the Ti-H eutectoid at about 1850° F. to a hydrogen level of about 0.77 wt.%, cooled to room temperature, dehydrogenated at about 1300° F., then cooled to room temperature. The photomicrograph reveals a fine alpha microstructure with a relatively high aspect ratio and with retention of the morphology of a martensitic structure.

FIG. 3 illustrates the microstructure of a coupon which was hydrogenated slightly below the Ti-H eutectoid temperature at about 1450° F. to a level of about 1.0 wt% hydrogen, then cooled to room temperature, as described previously. The photomicrograph reveals a relatively fine alpha microstructure.

FIG. 4 illustrates the microstructure of a coupon which was hydrogenated and cooled, using the same conditions given for the coupon shown in FIG. 2, dehydrogenated at about 1300° F. and then cooled to room temperature. The photomicrograph reveals a fine alpha microstructure with a relatively low aspect ratio. This microstructure of low aspect ratio alpha is known to be subject to easy superplastic deformation and is entirely different from the untreated structure shown in FIG. 1.

FIG. 5 illustrates the microstructure of a coupon which was hydrogenated above the Ti-H eutectoid temperature at about 1650° F. to a hydrogen level of about 0.76 wt%, then cooled to room temperature. The photomicrograph reveals a fine martensitic structure.

FIG. 6 illustrates the microstructure of a coupon which was hydrogenated and cooled using the same conditions given for the coupon shown in FIG. 4, dehydrogenated at about 1300° F., then cooled to room temperature. The photomicrograph reveals a fine alpha microstructure with a relatively high aspect ratio, separated by discontinuous films of beta phase. The photomicrograph also reveals retention of the morphology of the martensitic structure of the hydrogenated condition shown in FIG. 4. The fine lenticular alpha structure in a matrix of discontinuous beta phase is known from previous work to be superior in fatigue resistance when compared to the untreated structure shown in FIG. 1 and has better superplastic deformation characteristics than the original untreated microstructure shown in FIG. 1.

DETAILED DESCRIPTION OF THE INVENTION

Figure 1:
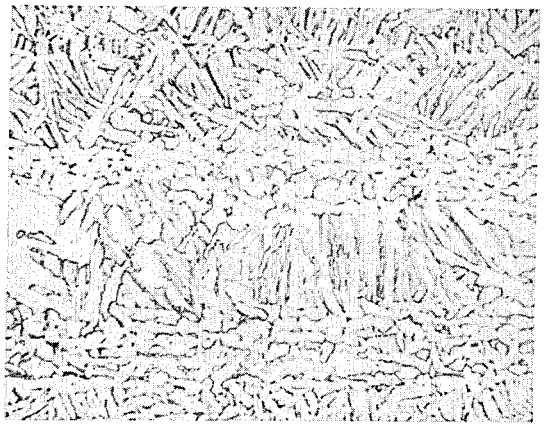
FIGS. 1–6 are 500x microphotographs of Ti-6Al-4V wrought coupons illustrating various levels of treatment.
Figure 2:
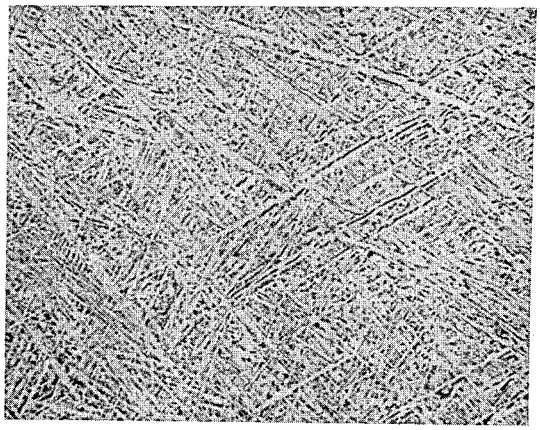
Figure 3:
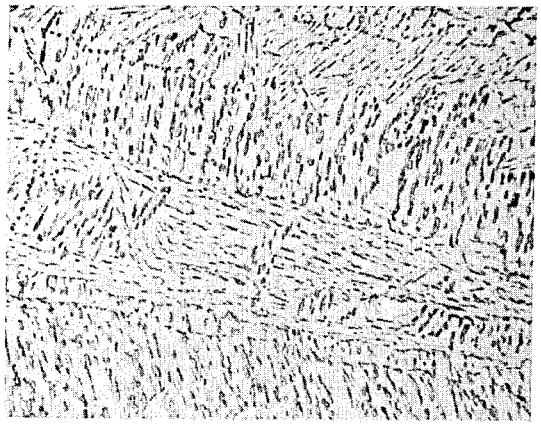
Figure 4:
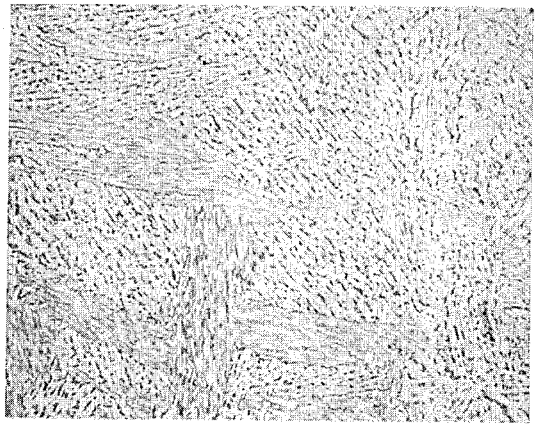
Figure 5:
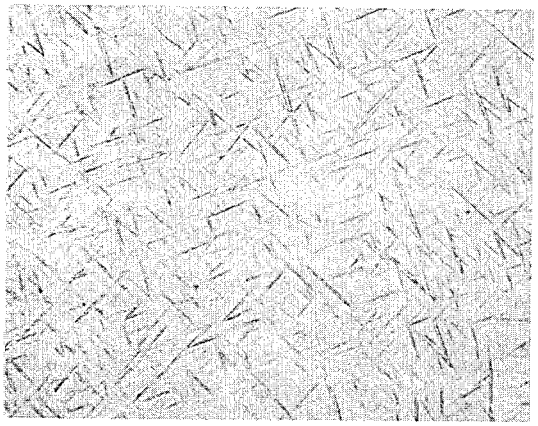
Figure 6:
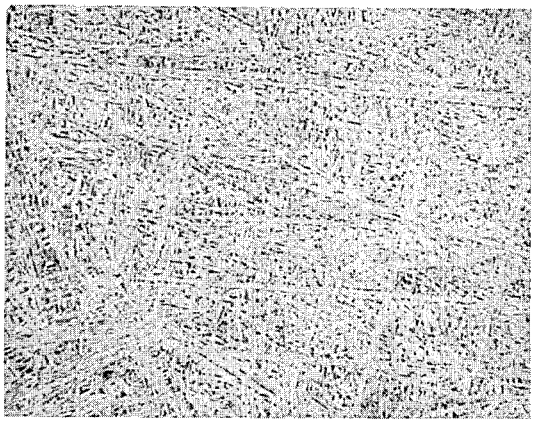

The titanium alloys which may be employed according to the present invention are the near-alpha, alpha-beta and near-beta alloys. Suitable alloys include, for example, Ti-5Al-6Sn-2Zr-1Mo-0.2Sn, Ti-6Al-2Sn-4Zr-2Mo-0.1Si, Ti-6Al-4V, Ti-6Al-6V-2Sn, Ti-6Al-2Sn-4Zr-6Mo, Ti-5Al-2Sn-2Zr-4Mo-4Cr, Ti-10V-2Fe-3Al, Ti-8Mo-8V-2Fe-3Al, Ti-3Al-8V-6Cr-4-Mo-4Zr, Ti-13V-11Cr-3Al and the like.

These alloys are employed according to the present invention in the form of wrought sheetstock, wrought plate or wrought articles. The term sheetstock, is intended to mean sheet-like material, having a thickness of about 0.020 to 0.250 inch (0.5 to 6.3 mm), preferably about 0.040 to 0.1875 inch (1.0 to 4.75 mm). The term plate is intended to mean sheet-like material having a thickness of at least about 0.250 inch and up to about 1.0 inch, or greater.

The titanium alloy material is first hydrogenated to a level of about 0.5 to 1.5 weight percent hydrogen. Titanium and its alloys have an affinity for hydrogen, being able to dissolve up to about 3 weight percent (60 atomic %) hydrogen at 590° C. While it may be possible to hydrogenate the article to the maximum quantity, it is presently preferred to hydrogenate the article to the level given above to prevent cracking during the subsequent cooling step. The addition of hydrogen is carried out using any suitable apparatus. Because hydrogen is highly flammable, it is presently preferred to carry out the hydrogenation using a mixture of hydrogen and an inert gas, such as argon or helium. A typical composition for the non-flammable gas environment would be a mixture consisting of 96 weight percent argon and four weight percent hydrogen, i.e., hydrogen makes up about 43 volume percent of the gas mixture. The composition of the gas is not critical, but it is preferred that the quantity of hydrogen be less than about 5 weight percent to avoid creation of a flammable mixture. It is also within the scope of this invention to employ a gas mixture containing more than about 5 weight percent hydrogen, as well as pure hydrogen.

The temperature at which the hydrogen is added to the alloy should be near or greater than the titanium-hydrogen eutectoid temperature of 815° C. (1500° F.). In general, the temperature of hydrogen addition can range from about 780° to 1020° C. (1435° to 1870° F.).

Following the hydrogenation step, the article is cooled from the hydrogenation temperature at a controlled rate to about room temperature. The rate is controlled to be about 5° to 40° C. per minute. This controlled rate cooling step is critical to providing the desired microstructure. If the rate is too high, cracking and distortion of the article may result. A slower cooling rate may lead to the formation of a coarse acicular structure which will not provide satisfactory fatigue properties.

While we do not wish to be held to any particular theory of operation, it is believed that as the hydrogenated article cools, metal hydrides, particularly titanium hydrides, form within the matrix of alpha and beta titanium. Because the metal hydrides have a different volume than the titanium matrix grains, there is initiated localized deformation on a microscopic scale. As a result, when the material is reheated for removal of the hydrogen, the microdeformed regions cause localized recrystallization.

Dehydrogenation of the hydrogenated article is accomplished by heating the article under vacuum to a temperature in the range of about 650° to 750° C., (1200° to 1380° F.). The time for the hydrogen removal will depend on the size and cross-section of the article, the volume of hydrogen to be removed, the temperature of dehydrogenation and the level of vacuum in the apparatus used for dehydrogenation. The term "vacuum" is intended to mean a vacuum of about $10^{-2}$ mm Hg or less, preferably about $10^{-4}$ mm Hg or less. The time for dehydrogenation must be sufficient to reduce the hydrogen content in the article to less than the maximum allowable level. For the alloy Ti-6Al-4V, the final hydrogen level must be below 120 ppm to avoid degradation of physical properties. Generally, about 15 to 60 minutes at dehydrogenation temperature and under vacuum, is sufficient to ensure substantially complete evolution of hydrogen from the article. Heating is then discontinued and the article is allowed to cool, at the previously described controlled rate, to room temperature. The following example illustrates the invention.

EXAMPLE

A series of wrought Ti-6Al-4V coupons was treated as shown in the following table:

TABLE

| | Hydrogenation | | Dyhydrogenation |
|---|---|---|---|
| FIGS. | Temp. (°F.) | Level (wt %) | Temp. (°F.) |
| 1 | — | 0.00 | — |
| 4 | 1450 | 1.00 | 1300 |
| 6 | 1650 | 0.76 | 1300 |
| 2 | 1850 | 0.77 | 1300 |
| 3 | 1450 | 1.00 | — |
| 5 | 1650 | 0.76 | — |

Various modifications may be made to the present invention without departing from the spirit thereof or the scope of the appended claims.

We claim:

1. A method for improving the microstructure of wrought titanium alloy material which comprises the steps of hydrogenating the material at a temperature near or greater than the titanium-hydrogen eutectoid temperature of 815° C., said temperature of hydrogenation being in the range of about 780° to 1020° C. to a hydrogen level of about 0.50 to 1.50 weight percent, cooling the thus-hydrogenated material to room temperature at a controlled rate, heating the thus-cooled, hydrogenated material to a temperature of about 650° to 750° C., applying a vacuum to dehydrogenate the material and cooling said material to room temperature at a controlled rate.

2. The method of claim 1 wherein said controlled cooling rate is about 5° to 40° per minute.

3. The method of claim 1 wherein said material is made of Ti-6Al-4V alloy.

4. The method of claim 3 wherein said hydrogenation is carried out at a temperature of about 1450 F. (787° C.) to a hydrogen level of about 1.0 wt. percent and wherein said dehydrogenation is carried out at about 1300° F. (704° C.).

5. The method of claim 3 wherein said hydrogenation is carried out at a temperature of about 1650° F. (899° C.) to a hydrogen level of about 0.76 wt. percent and wherein said dehydrogenation is carried out at about 1300° F. (704° C.).

6. The method of claim 3 wherein said hydrogenation is carried out at a temperature of about 1850° F. (1010° C.) to a hydrogen level of about 0.77 wt. percent and wherein said dehydrogenation is carried out at about 1300° F. (704° C.).

* * * * *